US009586214B2

(12) United States Patent
Lee

(10) Patent No.: US 9,586,214 B2
(45) Date of Patent: Mar. 7, 2017

(54) SHOWERHEAD WITH CONVENIENT MODE SWITCHING MECHANISM

(71) Applicant: Ransom Man Pan Lee, Kowloon (HK)

(72) Inventor: Ransom Man Pan Lee, Kowloon (HK)

(73) Assignee: AQUAmate K&B Limited, Kowloon (HK)

( * ) Notice: Subject to any disclaimer, the term of this patent is extended or adjusted under 35 U.S.C. 154(b) by 205 days.

(21) Appl. No.: 14/684,432

(22) Filed: Apr. 13, 2015

(65) Prior Publication Data

US 2016/0296952 A1 Oct. 13, 2016

(51) Int. Cl.

| | |
|---|---|
| ***B05B 1/18*** | (2006.01) |
| ***B05B 1/34*** | (2006.01) |
| ***E03C 1/04*** | (2006.01) |
| ***B05B 1/12*** | (2006.01) |
| ***B05B 1/16*** | (2006.01) |

(52) U.S. Cl.

CPC ..... *B05B 1/34* (2013.01); *B05B 1/12* (2013.01); *B05B 1/16* (2013.01); *B05B 1/18* (2013.01); *E03C 1/0408* (2013.01)

(58) Field of Classification Search

CPC .... B05B 1/14; B05B 1/18; B05B 1/12; B05B 1/16; B05B 1/34; E03C 1/0408

USPC ..... 239/436, 443, 391, 396, 581.1, 548

See application file for complete search history.

(56) References Cited

U.S. PATENT DOCUMENTS

| | | | | |
|---|---|---|---|---|
| 2014/0027234 | A1* | 1/2014 | Zhou | B05B 1/1636 192/43.1 |
| 2015/0238984 | A1* | 8/2015 | Lee | B05B 1/1609 239/447 |
| 2016/0221006 | A1* | 8/2016 | Lin | B05B 1/1636 |

* cited by examiner

*Primary Examiner* — Jason Boeckmann

(57) ABSTRACT

A showerhead with convenient mode switching mechanism includes a stationary plate, a water diverting plate, a gearwheel, a sliding groove, a stopper, a rotary plate, a rear plate, a showerhead casing, a stopper holder, a spray face fixedly engaged with the rotary plate, and a dial protruding outward from the spray face. Manual rotation of the rotary plate clockwise or anticlockwise effects movement of the pin of the stopper which then turns the gearwheel and the water diverting plate for switching to a different spray mode. Upon discontinuance of the manual rotation of the rotary plate, the rotary plate and the pin of the stopper are then biased to return to their original positions.

5 Claims, 6 Drawing Sheets

SHOWERHEAD WITH CONVENIENT MODE SWITCHING MECHANISM

BACKGROUND OF THE INVENTION

The present invention relates to a showerhead and more particularly pertains to a showerhead with convenient mode switching mechanism.

Nowadays, many showerheads available in the marketplace are provided with different shower modes. Mechanical and electronic mode switching are available. For mechanical mode switching, user needs to turn an annular ring surrounding the circumference of the showerhead to specific positions to switch to specific shower modes. As user usually switches shower mode during shower, user's hand usually interferes with water emerging from the showerhead and thus causes the water to deflect in undesired directions. Besides, it is often difficult to see clearly during shower and thus it is difficult for user to turn the annular ring accurately to achieve a specific shower mode. As for electronic mode switching, it is usually expensive and thus may not be affordable to all market sectors.

BRIEF SUMMARY OF THE INVENTION

In view of the aforesaid disadvantages now present in the prior art, the present invention provides a showerhead with convenient mode switching mechanism which is convenient to operate, and low in manufacturing costs.

To attain this, the present invention generally comprises:

a stationary plate having a central aperture and a stationary plate aperture which fluidly communicates with a water supply;

a water diverting plate having a shaft extending from center of the water diverting plate to the central aperture of the stationary plate and a plurality of water diverting apertures disposed around the shaft and fluidly communicate with the stationary plate aperture, and rotation of the water diverting plate provides different spray modes by selectively providing fluid communication between the plurality of water diverting apertures and specific water pathways leading to specific nozzles on a spray face;

a gearwheel having a plurality of identical tooth gaps and mounted on the shaft of the water diverting plate with an interference fit for rotating the water diverting plate freely within the central aperture;

a sliding groove disposed on the stationary plate and having two symmetrical elongated raised portions within the sliding groove; the two raised portions each has a slanted inner edge facing each other to form a V-shaped notch in middle of the sliding groove and an elliptical pathway on each of a clockwise side and an anticlockwise side of the V-shaped notch;

a stopper having a first stopper end which corresponds to one of the plurality of tooth gaps of the gearwheel in shape and size and a pin configured to be received in and move in the elliptical pathways and the V-shaped notch in the sliding groove, wherein the stopper is movable between an operating position where the first stopper end engages with one of the plurality of tooth gaps of the gearwheel and a stopping position where the first stopper end is removed from contacting the gearwheel, and the stopper is biased towards the stopping position by a biasing spring disposed at a second end of the stopper;

a rotary plate rotatably engaged with the stationary plate and rotatable among a default central position, a clockwise position and an anticlockwise position and biased towards the default central position; the rotary plate is fixed in relation to the stopper so that manual rotation of the rotary plate from the default central position to either the clockwise position or the anticlockwise position moves the pin of the stopper from the stopping position at the V-shaped notch to the operating position and along an upper portion of the elliptical pathway on the clockwise side or the anticlockwise side of the sliding groove, thus turning the gearwheel and the water diverting plate clockwise or anticlockwise for switching to a different spray mode; and as the pin reaches an end of the upper portion of the elliptical pathway, discontinuance of manual rotation of the rotary plate and the biasing spring causes the pin to move automatically downward along the elliptical pathway to reach a lower portion of the elliptical pathway and thus reaches the stopping position where the pin is removed from contacting the gearwheel, thus the gearwheel and the water diverting plate stops turning, and as the rotary plate is biased to return to the default central position, the pin of the stopper is forced to move along the lower portion of the elliptical pathway back to the V-shaped notch.

The showerhead further comprises a rear plate engaged with a showerhead casing, wherein the rear plate has a rear plate aperture which fluidly communicates with a water supply and the stationary plate aperture.

The showerhead further comprises a stopper holder having a stopper holding portion for receiving the stopper and a gearwheel holding portion which aligns with the central aperture of the water diverting plate for rotatably receiving the gearwheel; the stopper holding portion is fixedly engaged with the rotary plate by positioning between two protruding pieces disposed on the rotary plate.

The showerhead further comprises a dial protruding outward from the spray face, and the spray face is fixedly engaged with the rotary plate so that manual rotation of the dial achieves manual rotation of the rotary plate.

The stationary plate and the rotary plate abut against each other and provide two symmetrical spring receiving chambers at a top center portion; a spring is received in each of the two spring receiving chambers to bias the rotary plate towards the default central position.

DETAILED DESCRIPTION OF THE INVENTION

Figure 1:
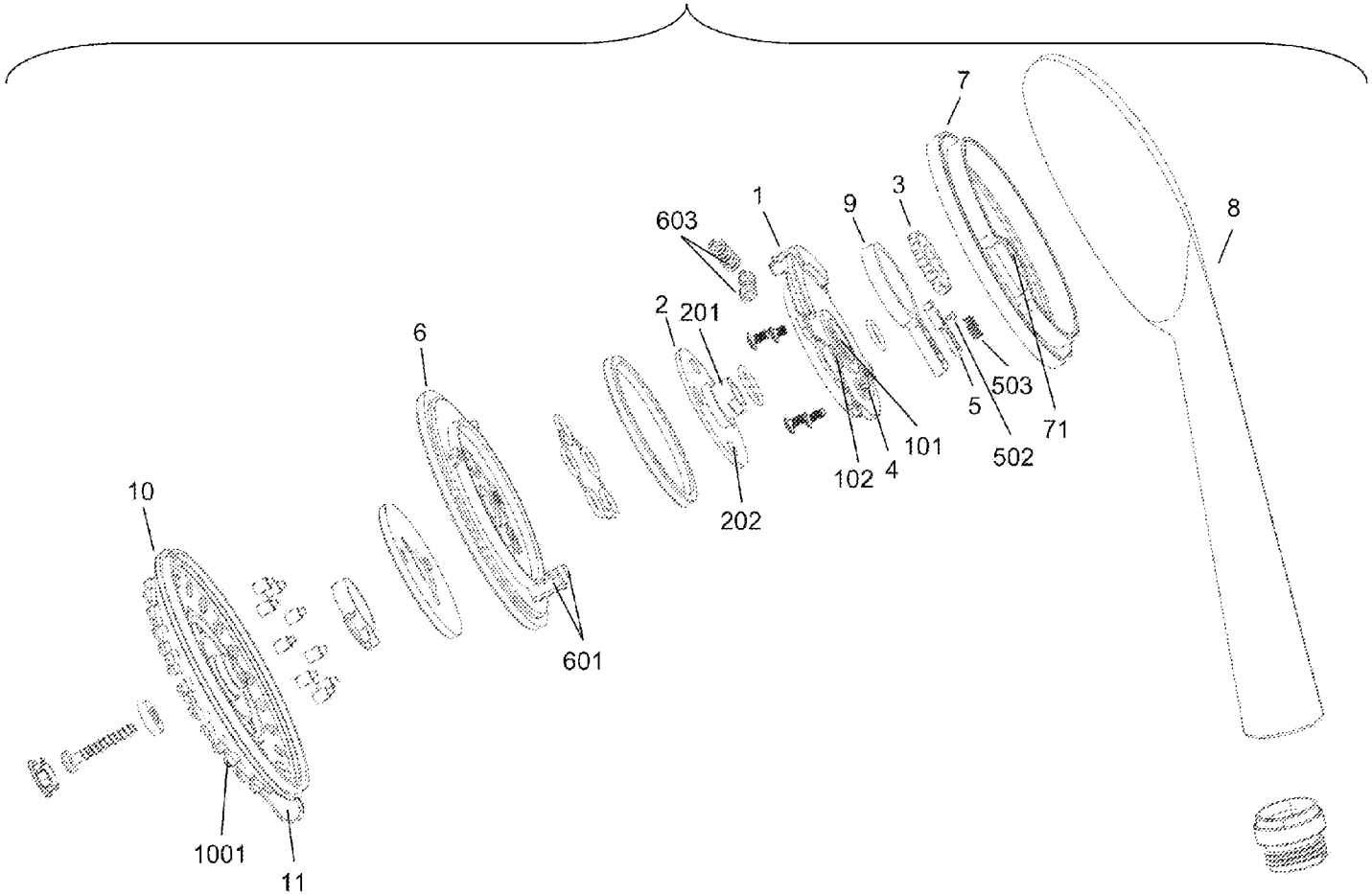
FIG. 1 is an exploded view of a preferred embodiment of the present invention.
Figure 2:
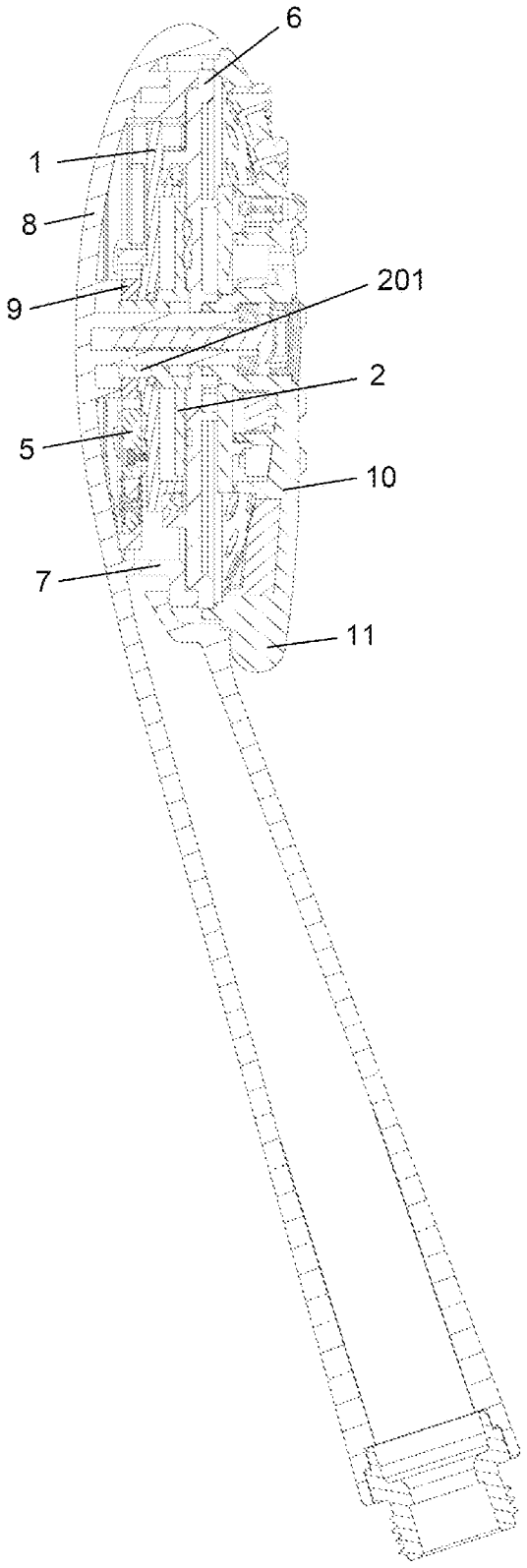
FIG. 2 is a sectional view of the embodiment as shown in FIG. 1.
Figure 3:
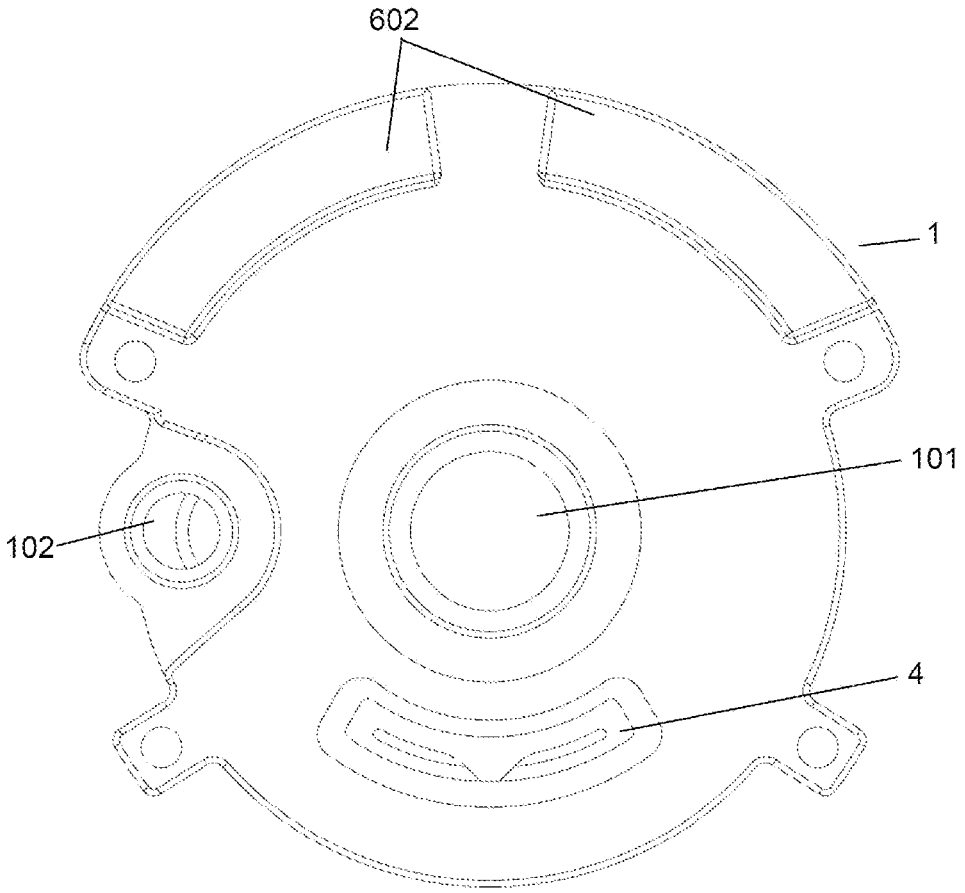
FIG. 3 is an elevational view of the stationary plate of the embodiment as shown in FIG. 1.
Figure 4:
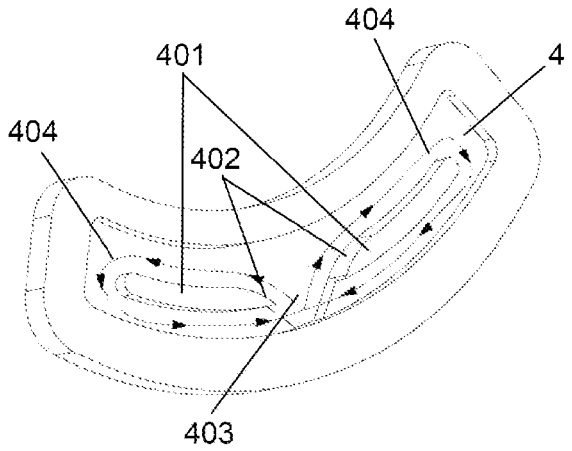
FIG. 4 is enlarged view of the sliding groove on the stationary plate of the embodiment as shown in FIG. 1.
Figure 5:
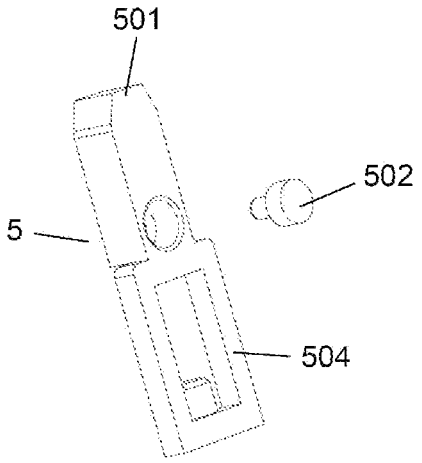
FIG. 5 is an exploded view of the stopper of the embodiment as shown in FIG. 1.
Figure 6:
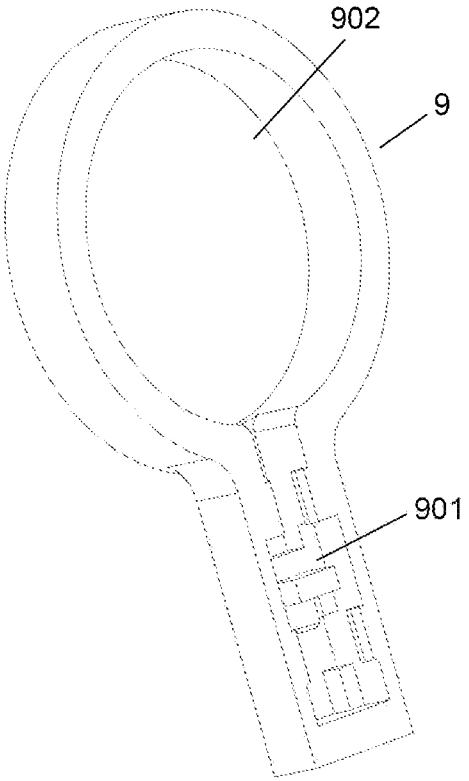
FIG. 6 is a perspective view of the stopper holder of the embodiment as shown in FIG. 1.
Figure 7:
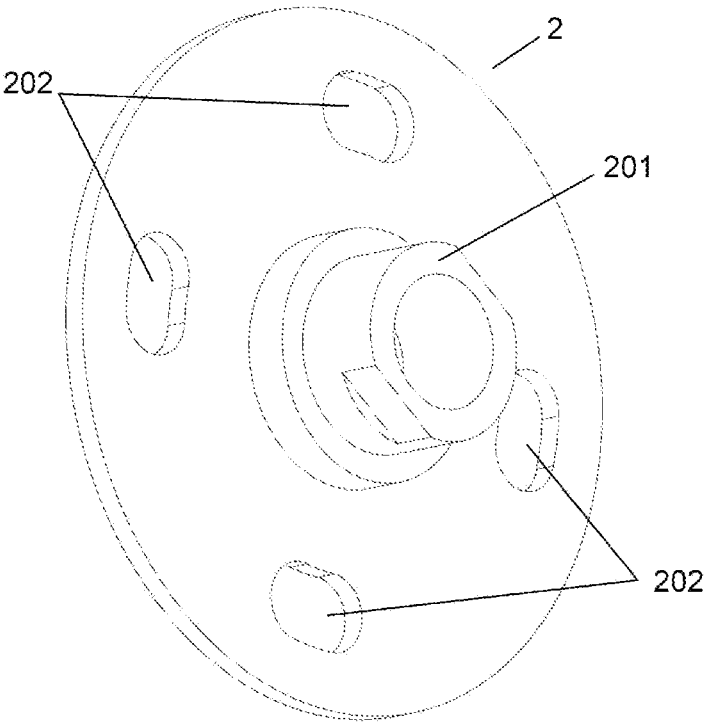
FIG. 7 is a perspective view of the water diverting plate of the embodiment as shown in FIG. 1.
Figure 8:
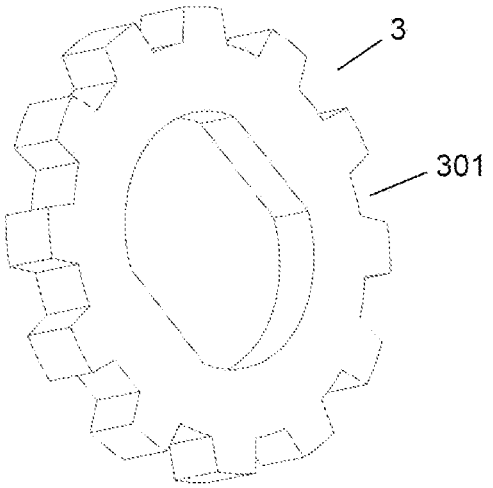
FIG. 8 is a perspective view of the gearwheel of the embodiment as shown in FIG. 1.
Figure 9:
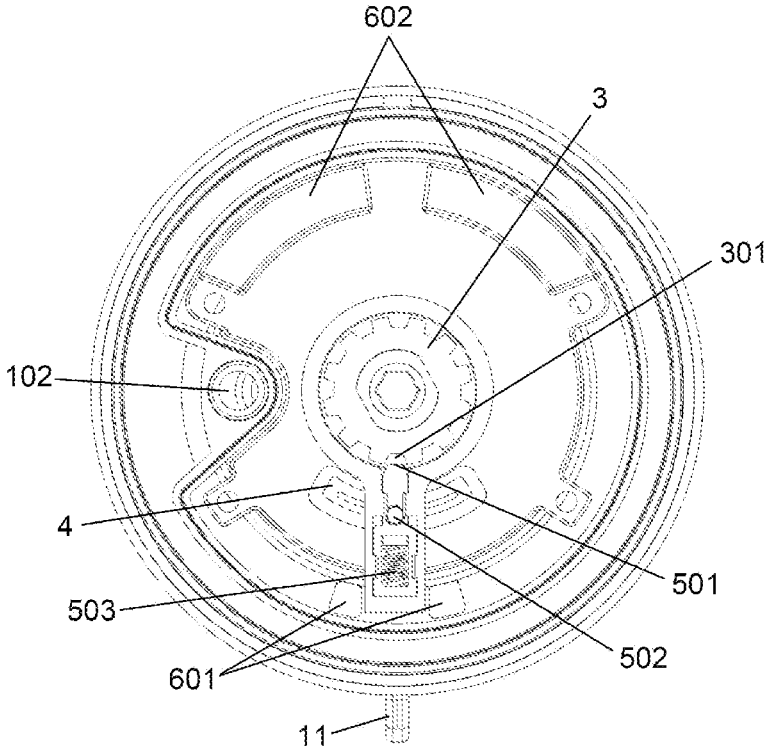
FIG. 9 is an elevational view illustrating the position of the rotary plate at the default central position in the embodiment as shown in FIG. 1.
Figure 10:
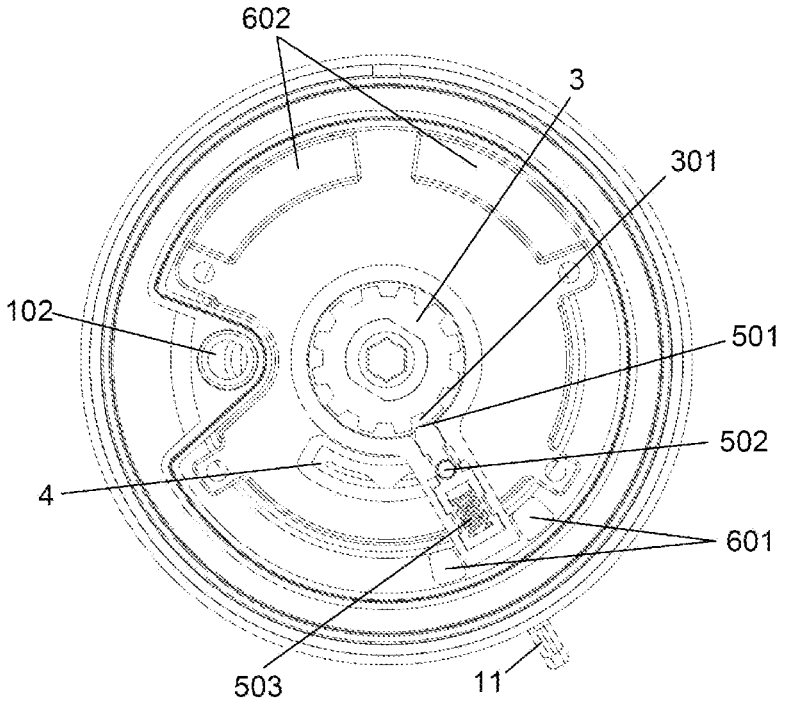
FIG. 10 is an elevational view illustrating the position of the rotary plate at the clockwise position in the embodiment as shown in FIG. 1.

As shown in FIGS. 1-10, a preferred embodiment of the showerhead of the present invention comprises a stationary plate 1, a water diverting plate 2, a gearwheel 3, a sliding groove 4, a stopper 5, a rotary plate 6, a rear plate 7, a showerhead casing 8, a stopper holder 9, a spray face 10 fixedly engaged with the rotary plate 6, and a dial 11 protruding outward from the spray face 10.

The stationary plate 1 has a central aperture 101 and a stationary plate aperture 102 which fluidly communicates with a water supply. In this embodiment, the stationary plate aperture 102 fluidly communicates a rear plate aperture 71 on the rear plate 7 which fluidly communicates with a water supply. The rear plate 7 engages with the showerhead casing 8.

The water diverting plate 2 has a shaft 201 extending from center of the water diverting plate 2 to the central aperture 101 of the stationary plate 1 and a plurality of water diverting apertures 202 disposed around the shaft 201 and fluidly communicate with the stationary plate aperture 102, and rotation of the water diverting plate 2 provides different spray modes by selectively providing fluid communication between the plurality of water diverting apertures 202 and specific water pathways leading to specific nozzles 1001 on the spray face 10.

The gearwheel 3 has a plurality of identical tooth gaps 301 and mounted on the shaft 201 of the water diverting plate 2 with an interference fit for rotating the water diverting plate 2 freely within the central aperture 101.

The sliding groove 4 is disposed on the stationary plate 1 and has two symmetrical elongated raised portions 401 within the sliding groove 4; the two raised portions 401 each has a slanted inner edge 402 facing each other to form a V-shaped notch 403 in middle of the sliding groove 4 and an elliptical pathway 404 on each of a clockwise side and an anticlockwise side of the V-shaped notch 403.

The stopper 5 has a first stopper end 501 which corresponds to one of the plurality of tooth gaps 301 of the gearwheel 3 in shape and size and a pin 502 configured to be received in and move in the elliptical pathways 404 and the V-shaped notch 403 in the sliding groove 4. The stopper 5 is movable between an operating position where the first stopper end 501 engages with one of the plurality of tooth gaps 301 of the gearwheel 3 and a stopping position where the first stopper end 501 is removed from contacting the gearwheel 3, and the stopper 5 is biased towards the stopping position by a biasing spring 503 disposed at a second end 504 of the stopper 5.

In this embodiment, the stopper 5 is received in a stopper holding portion 901 in the stopper holder 9. The stopper holder 9 further has a gearwheel holding portion 902 which aligns with the central aperture 101 of the water diverting plate 1 for rotatably receiving the gearwheel 3. The stopper holding portion 901 is fixedly engaged with the rotary plate 6 by positioning between two protruding pieces 601 disposed on the rotary plate 6.

The rotary plate 6 is rotatably engaged with the stationary plate 1 and rotatable among a default central position, a clockwise position and an anticlockwise position. The stationary plate 1 and the rotary plate 6 abut against each other and provide two symmetrical spring receiving chambers 602 at a top center portion; a spring 603 is received in each of the two spring receiving chambers 602 to bias the rotary plate 6 towards the default central position. As the rotary plate 6 is fixed in relation to the stopper 5, manual rotation of the rotary plate 6 from the default central position to either the clockwise position or the anticlockwise position moves the pin 502 of the stopper 5 from the stopping position at the V-shaped notch 403 to the operating position and along an upper portion of the elliptical pathway 404 on the clockwise side or the anticlockwise side of the sliding groove 4, thus turning the gearwheel 3 and the water diverting plate 2 clockwise or anticlockwise for switching to a different spray mode; and as the pin 502 reaches an end of the upper portion of the elliptical pathway 404, discontinuance of manual rotation of the rotary plate 6 and the biasing spring 503 causes the pin 502 to move automatically downward along the elliptical pathway 404 to reach a lower portion of the elliptical pathway 404 and thus reaches the stopping position where the pin 502 is removed from contacting the gearwheel 3, thus the gearwheel 3 and the water diverting plate 2 stops turning, and as the rotary plate 6 is biased to return to the default central position, the pin 502 of the stopper 5 is forced to move along the lower portion of the elliptical pathway 404 back to the V-shaped notch 403.

The present embodiment operates as follows:

Initially, the showerhead is at a first spray mode wherein a first set of the water diverting apertures 202 fluidly communicates with a first water pathway leading to a first set of nozzles 1001 on the spray face 10, thus water from the water supply flows through the rear plate aperture 71 and the stationary plate aperture 102 to the first set of the water diverting apertures 202 and thereafter along the first water pathway to the first set of nozzles 1001.

As the user turns the dial 11 on the spray face 10 clockwise, the rotary plate 6 overcomes the biasing force of the spring 603 in the spring receiving chamber 602 on the clockwise side and rotates clockwise from the default central position to the clockwise position; the stopper holder 9 and the stopper 5 are forced to turn with the rotary plate 6, and so the pin 502 of the stopper 5 overcomes the biasing force of the biasing spring 503 to move from the stopping position at bottom of the V-shaped notch 403 upwards along the slanted inner edge 402 of the raised portions 401 on the clockwise side, thus bringing the first stopper end 501 of the stopper 5 to the operating position to engage with one of the plurality of tooth gaps 301 of the gearwheel 3. As the user continues to turn the dial 11, the pin 502 turns the gearwheel 3 correspondingly as it moves along the upper portion of the elliptical pathway 404 on the clockwise side of the V-shaped notch 403 towards a clockwise direction, and the water diverting plate 2 thus turns together with the gearwheel 3 for switching to a different spray mode. When the pin 502 reaches the end of the upper portion of the elliptical pathway 404, the elliptical pathway 404 restricts the pin 502 from moving clockwise further, thus signaling the user to stop turning and release the dial 11. As the user stops turning and releases the dial 11, the biasing spring 503 causes the pin 502 to move automatically downward along the elliptical pathway 404 to reach the lower portion of the elliptical pathway 404 and thus reaches the stopping position where the first stopper end 501 of the stopper 5 is removed from contacting the gearwheel 3, thus the water diverting plate 2 stops turning. As the rotary plate 6 is biased by the spring 603 in the spring receiving chamber 602 on the clockwise side to return to the default central position, the pin 502 of the stopper 5 is forced to move along the lower portion of the elliptical pathway 404 towards an anticlockwise direction back to the V-shaped notch 403. The operation for anticlockwise rotation of the dial 11 is substantially similar to the aforementioned operation for clockwise rotation of the dial except that the direction is changed from clockwise to anticlockwise and so the details are not repeated herein. The movement of the pin 502 in the V-shaped notch 403 and the elliptical pathways 404 are illustrated in the arrow paths in FIG. 4.

The above embodiments are preferred embodiments of the present invention. The present invention is capable of other embodiments and is not limited by the above embodiments. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A showerhead with convenient mode switching mechanism which comprises:

a stationary plate having a central aperture and a stationary plate aperture which fluidly communicates with a water supply;

a water diverting plate having a shaft extending from center of the water diverting plate to the central aperture of the stationary plate and a plurality of water diverting apertures disposed around the shaft and fluidly communicate with the stationary plate aperture, and rotation of the water diverting plate provides different spray modes by selectively providing fluid communication between the plurality of water diverting apertures and specific water pathways leading to specific nozzles on a spray face;

a gearwheel having a plurality of identical tooth gaps and mounted on the shaft of the water diverting plate with an interference fit for rotating the water diverting plate freely within the central aperture;

a sliding groove disposed on the stationary plate and having two symmetrical elongated raised portions within the sliding groove; the two raised portions each has a slanted inner edge facing each other to form a V-shaped notch in middle of the sliding groove and an elliptical pathway on each of a clockwise side and an anticlockwise side of the V-shaped notch;

a stopper having a first stopper end which corresponds to one of the plurality of tooth gaps of the gearwheel in shape and size and a pin configured to be received in and move in the elliptical pathways and the V-shaped notch in the sliding groove, wherein the stopper is movable between an operating position where the first stopper end engages with one of the plurality of tooth gaps of the gearwheel and a stopping position where the first stopper end is removed from contacting the gearwheel, and the stopper is biased towards the stopping position by a biasing spring disposed at a second end of the stopper;

a rotary plate rotatably engaged with the stationary plate and rotatable among a default central position, a clockwise position and an anticlockwise position and biased towards the default central position; the rotary plate is fixed in relation to the stopper so that manual rotation of the rotary plate from the default central position to either the clockwise position or the anticlockwise position moves the pin of the stopper from the stopping position at the V-shaped notch to the operating position and along an upper portion of the elliptical pathway on the clockwise side or the anticlockwise side of the sliding groove, thus turning the gearwheel and the water diverting plate clockwise or anticlockwise for switching to a different spray mode; and as the pin reaches an end of the upper portion of the elliptical pathway, discontinuance of manual rotation of the rotary plate and the biasing spring causes the pin to move automatically downward along the elliptical pathway to reach a lower portion of the elliptical pathway and thus reaches the stopping position where the pin is removed from contacting the gearwheel, thus the gearwheel and the water diverting plate stops turning, and as the rotary plate is biased to return to the default central position, the pin of the stopper is forced to move along the lower portion of the elliptical pathway back to the V-shaped notch.

2. The showerhead as in claim 1, wherein it further comprises a rear plate engaged with a showerhead casing, wherein the rear plate has a rear plate aperture which fluidly communicates with a water supply and the stationary plate aperture.

3. The showerhead as in claim 1, wherein it further comprises a stopper holder having a stopper holding portion for receiving the stopper and a gearwheel holding portion which aligns with the central aperture of the water diverting plate for rotatably receiving the gearwheel; the stopper holding portion is fixedly engaged with the rotary plate by positioning between two protruding pieces disposed on the rotary plate.

4. The showerhead as in claim 1, wherein it further comprises a dial protruding outward from the spray face, and the spray face is fixedly engaged with the rotary plate so that manual rotation of the dial achieves manual rotation of the rotary plate.

5. The showerhead as in claim 1, wherein the stationary plate and the rotary plate abut against each other and provide two symmetrical spring receiving chambers at a top center portion; a spring is received in each of the two spring receiving chambers to bias the rotary plate towards the default central position.

* * * * *